US005207171A

United States Patent [19]

Westwood, III

[11] Patent Number: 5,207,171

[45] Date of Patent: May 4, 1993

[54] ADJUSTABLE ROPE LOCK

[76] Inventor: Samuel M. Westwood, III, 2005 Linden St., Bethlehem, Pa. 18017

[21] Appl. No.: 791,852

[22] Filed: Nov. 14, 1991

[51] Int. Cl.[5] ..... B63B 21/04

[52] U.S. Cl. ..... 114/218; 24/129 R; 24/132 R; 114/219

[58] Field of Search ..... 114/218, 219; 24/115 R, 24/115 M, 115 K, 128, 129 R, 130, 132 R, 133

[56] References Cited

U.S. PATENT DOCUMENTS

| | | | |
|---|---|---|---|
| 106,549 | 8/1870 | Chandler . | |
| 297,158 | 4/1884 | Pitney . | |
| 334,711 | 1/1886 | Lorenz . | |
| 346,390 | 7/1886 | Thomas | 24/129 R |
| 436,315 | 9/1890 | Peck | 24/136 R |
| 642,889 | 2/1900 | Whitner | 24/133 |
| 790,929 | 5/1905 | Smith | 24/129 R |
| 950,702 | 3/1910 | O'Brien | 24/133 |
| 1,034,741 | 8/1912 | Smith | 24/129 R |
| 1,623,615 | 4/1927 | Bona | 24/133 |
| 2,113,731 | 4/1938 | Kennedy | 24/713.2 |
| 2,482,231 | 9/1949 | White | 114/218 |
| 3,309,745 | 3/1967 | Gintz et al. | 24/129 R |
| 3,650,236 | 3/1972 | McFarlane | 114/218 |
| 4,809,408 | 3/1989 | Abrahamson | 24/115 M |
| 4,912,816 | 4/1990 | Brandt | 24/129 R |
| 4,919,370 | 4/1990 | Martin et al. | 24/129 R |
| 5,035,558 | 7/1991 | Prosen | 24/130 |

*Primary Examiner*—Sherman Basinger

*Attorney, Agent, or Firm*—Jacobson, Price, Holman & Stern

[57] ABSTRACT

An adjustable rope lock including a body of material having converging passageways extending therethrough with the passageways terminating at one edge of the body in a joined, merged passageway and terminating at an opposite edge of the body in spaced relation with the rope being threaded through the passageways with the two ends of the rope extending outwardly from the merged passageway at one edge of the body. The merged passageway from which the free ends of the rope extend is generally elliptical in shape although the specific configuration can vary with the ropes being positioned one above the other with one rope supporting a load and forming a taut rope segment. The other rope is the adjustable rope and forms a pull rope segment which may be pulled freely to take up slack, maintain or increase tension.

14 Claims, 5 Drawing Sheets

ADJUSTABLE ROPE LOCK

BACKGROUND OF THE INVENTION

1. Field Of The Invention

The present invention generally relates to a device for easily and quickly locking and releasing a flexible rope in an adjusted position in relation to an anchor point which is more reliable and secure than forming knots in the rope with adjustment or tensioning of the rope being accomplished with the present device much quicker than tieing knots. The adjustable rope lock of the present invention enables the rope to be easily secured in or released from adjusted position by the use of a single hand thus greatly facilitating the use of this device in adjustably securing ropes in various use environments.

The adjustable rope lock includes a body of material having converging passageways extending therethrough with the passageways terminating at one edge of the body in a joined, merged passageway and terminating at an opposite edge of the body in spaced relation with the rope being threaded through the passageways with the two ends of the rope extending outwardly from the merged passageway at one edge of the body. The merged passageway from which the free ends of the rope extend is generally elliptical in shape although the specific configuration can vary with the ropes being positioned one above the other with one rope supporting a load and forming a taut rope segment. The other rope is the adjustable rope and forms a pull rope segment which may be pulled freely to take up slack, maintain or increase tension.

2. Description of the Prior Art

Various devices have been provided which enable a rope to be adjustably connected to an anchor point. However, such devices include various types of clamp devices, hooks, brackets, cleats and the like which require that the rope be wrapped around or tied into a knot to adjustably connect the rope to an anchor point. The following U.S. patents relate to rope anchoring devices.

U.S. Pat. No. 106,549
U.S. Pat. No. 297,158
U.S. Pat. No. 334,711
U.S. Pat. No. 346,390
U.S. Pat. No. 436,315
U.S. Pat. No. 2,113,731
U.S. Pat. No. 4,912,816

While the prior art discloses devices for adjustably connecting a rope to an anchor point, the prior art does not disclose the specific structure of the present invention in which a load or taut rope segment can be adjusted in relation to a body by manipulating a pull rope segment in a linear direction. Further, the prior art does not disclose the various specific structural modifications of the present invention all of which include a specific passageway arrangement in a body which receives the adjustable rope therethrough with the passageways being of a particular configuration and arrangement to receive the rope and securely but releasably lock the rope in an adjusted position to maintain the taut rope segment in a taut condition.

SUMMARY OF THE INVENTION

An object of the present invention is to provide an adjustable rope lock which enables a rope to be quickly and easily adjusted and held securely in adjusted position to enable tension on a rope to be adjusted and maintained with adjustment of the rope being accomplished by a single hand operation.

Another object of the invention is to provide an adjustable rope lock in which the rope is held in secure tensioned position that is maintained by frictional engagement due to the internal structure of the device and the association of the rope segments extending therethrough with the friction/tension locking arrangement remaining securely set until released by a simple, single hand twisting or tilting motion of the device to enable quick adjustment and secure tension in all sizes of hand ropes in a manner that is more reliable and less time consuming than forming knots.

A further object of the invention is to provide an adjustable rope lock that is quite cost effective as compared to racheting and other tensioning devices for ropes and which can be constructed of various materials in various sizes depending upon the performance requirements and cost parameters with the device being especially effective on cords or ropes of various sizes and specifically on nylon woven rope which tends to be slippery and difficult to tie securely in tension.

Still another object of the invention is to provide an adjustable rope lock which is small, lightweight and easily transported and stored and which can be used for general use in tie-down, rigging, various fieldwork, and the like where set up, adjustment and take down with ropes and lines may be required with the device also being capable of safely lifting and lowering personnel and other loads and enabling a single person to accomplish some tasks that previously required two people.

A still further object of the invention is to provide an adjustable rope lock having various configurations and adaptations for various functions and uses where it is necessary to secure a rope in adjusted tensioned position in a secure and safe manner but yet enables the rope to be quickly and easily released for linear movement to a new position with subsequent frictional locking of the rope under tension being easily accomplished.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 8 is a perspective view of another embodiment of the invention illustrating the body supported from a wall mounted hook or the like.

FIG. 10 illustrates another embodiment of the invention incorporating a supporting structure connected with a boat rail or the like.

DESCRIPTION OF THE PREFERRED EMBODIMENTS

Figure 2A:
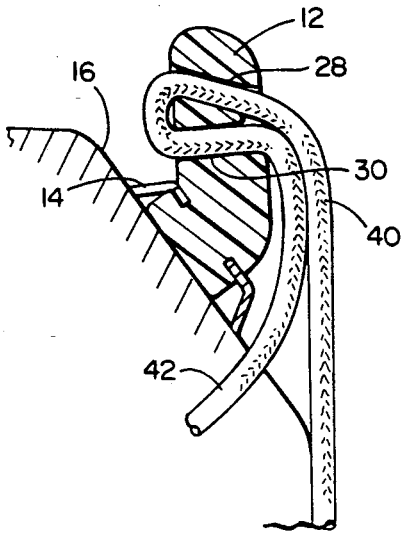
FIGS. 2A, 2B and 2C are views similar to FIG. 2 but illustrating alternative mounting arrangements and rope segment orientation.
Figure 2B:
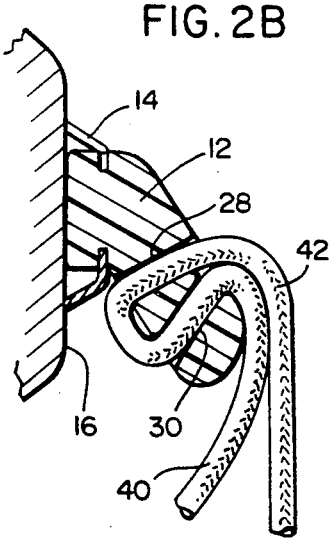
Figure 2:
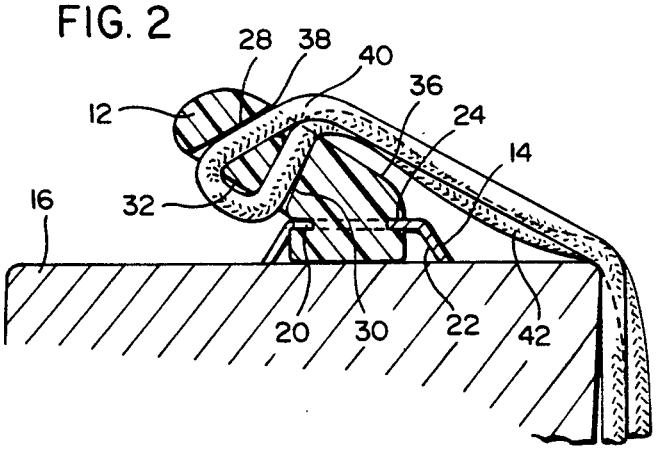
FIG. 2 is a sectional view taken along section line 2—2 on FIG. 1 illustrating the specific structural details of the adjustable rope lock.
Figure 2C:
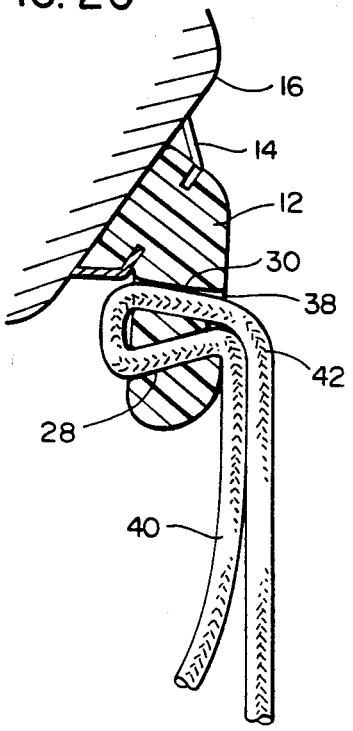

Referring now specifically to the drawings, the adjustable rope lock of the present invention is generally designated by reference numeral 10 and includes a body 12 that is removably attached to a hollow support plate 14 secured to the upper surface of a boat gunwale 16 by fastener screws 18. The plate 14 includes a generally U-shaped notch or recess 20 which is spaced above gunwale 16 at 22 as illustrated in FIG. 2 which slidably and releasably receives a groove 24 on the lower end of the body 12. The body 12 may have rounded outer surfaces as at 26 and may be of any suitable shape or configuration and releasably mounted on the plate 14 by sliding into the notch 20.

Figure 3:
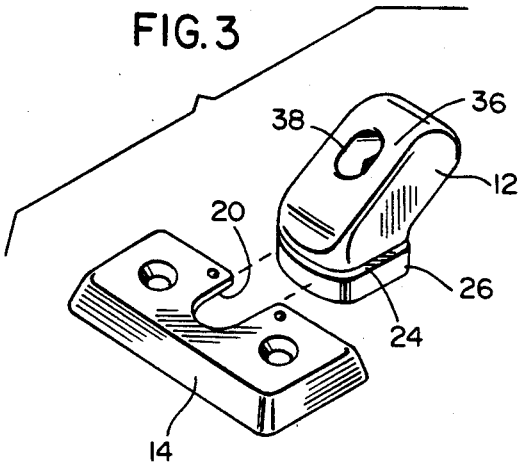
FIG. 3 is an exploded perspective view of the bracket used with the adjustable rope lock.

The body 12 includes passageways 28 and 30 extending therethrough as illustrated in FIG. 2 with one end of each of the passageways 28 and 30 terminating at one face 32 of the body 12 in vertically spaced relation. The other end of the passageway 28 and 30 merge and, join at face 36 of the body 12 to form an elliptical-shaped opening 38 as shown in FIG. 3. A taut rope segment 40 extends in through the elliptical opening 38 and through the passageway 28 for exit therefrom at the face 32 of the body 12 and the taut rope segment then extends vertically downwardly and in through the passageway 30 as pull rope segment 42 which is below the passageway 28. The taut rope segment 40 forms a tension cord or load supporting cord or rope and is a taut or tensioned line and can support a boat fender 44 in an adjustable manner with the free end of the pull rope segment 42 as designated by numeral 46 enabling the fender 44 to be adjusted upwardly or downwardly with a single hand being able to pull the rope end 46 to release and pull the rope through the rope lock and then relock it or release the rope and pa it out through the adjustable rope lock and lock the rope in adjusted position thus locking the boat fender in an adjustable position.

With this construction, the taut rope segment 40 enters the body 12 and oval-shaped elongate opening 38 and passageway 28 above the pull rope segment 42 which extends out from the passageway 30 and the elliptical opening 38 with the pull rope segment 42 and taut rope segment 40 having a degree of angle therebetween which insures that rope segment 40 becomes frictionally engaged with rope segment 42 to prevent rope segment 40 from being pulled out of the body. Thus, pull rope segment 42 may be pulled freely to take up slack, maintain or increase tension on taut rope segment 40. If rope segment 42 is pulled above rope segment 40, it will have the same locking effect that rope segment 40 has bearing on rope segment 42. The opening 38 on face 36 of the body is aligned with the centers of the exit openings from the passageways 28 and 30 to the face 32 of the body 12. The positioning of the elliptical opening 38 may be raised or lowered in relation to the centers of the openings at the face 32 of the body 12 with the relationship between the opening 38 and the openings into face 32 enabling variation of the degree of the angle between the taut rope segment 40 in relation to the pull rope segment 42. FIGS. 2A, B and C illustrate variations in the mounting position of the mounting plate 14, the body 12 and the relation of the rope segments 40 and 42.

Figure 4:
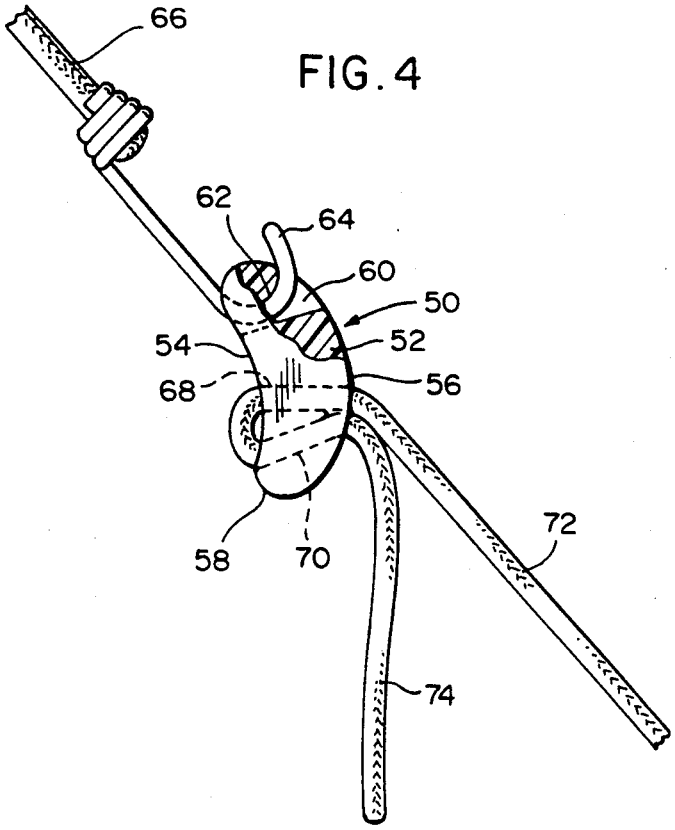
FIG. 4 is a side elevational view of the adjustable rope lock illustrating another embodiment of the invention.

FIG. 4 illustrates another embodiment of the invention generally designated by reference numeral 50 including a body 52 having a generally arcuate configuration and provided with a concave side edge 54, and a convex side edge 56 and rounded ends 58. One end of the body 52 includes a passageway 60 therethrough having a rounded upper end 62 receiving a hook 64 attached to one end of a resilient cord 66 such as a bungee cord that can be connected to any suitable anchor point with the resilient cord 66 maintaining resilient tension on the body 52. The other end of the body 52 includes passageways 68 and 70 comparable to the passageways 28 and 30 illustrated in FIG. 2 with the taut rope segment 72 being the load segment and the pull rope segment 74 being the loose rope segment by which the rope can be moved by pulling on the rope segment 74 even with bearing pressure thereon. In this construction the body 52 can tilt to release the adjustable rope lock 50 thus enabling the rope segments 72 or 74 to be moved in either direction depending upon the orientation of the body 52. For example, if the taut rope segment 72 is under tension, the body 52 can be tilted by moving the lower end 58 clockwise as illustrated in FIG. 4. This movement unlocks the rope segment 72 to enable it to be pulled outwardly with the rope segment 74 being moved inwardly toward the body 52 since it is not taut. Also, when the taut rope segment 72 is taut, the pull rope segment 74 can be pulled to automatically take up any slack that may have existed in the taut rope segment 72.

Figure 5:
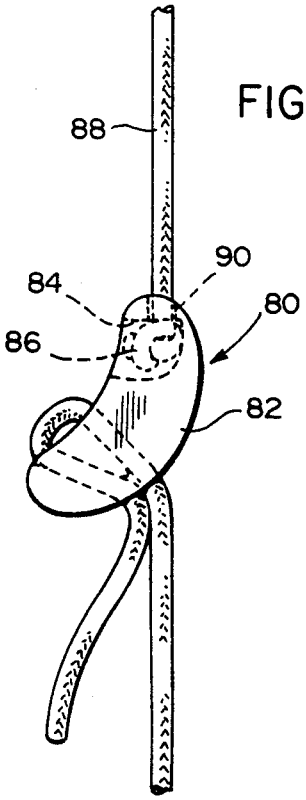
FIG. 5 is a side elevational view of another embodiment of the adjustable rope lock.

FIG. 5 illustrates a variation of the structure illustrated in FIG. 4 which is designated by reference numeral 80 and includes a body 82 very similar to the body 52 except that in the upper end thereof, there is a recess 84 which receives a knot 86 on the lower end of an anchor rope or cord 88 which extends through a passageway 90 into the recess 84 thus, supporting the body 82 from the rope or cord 88 and still enabling the body 82 to function in the same manner as the embodiment illustrated in FIG. 4.

Figure 6:
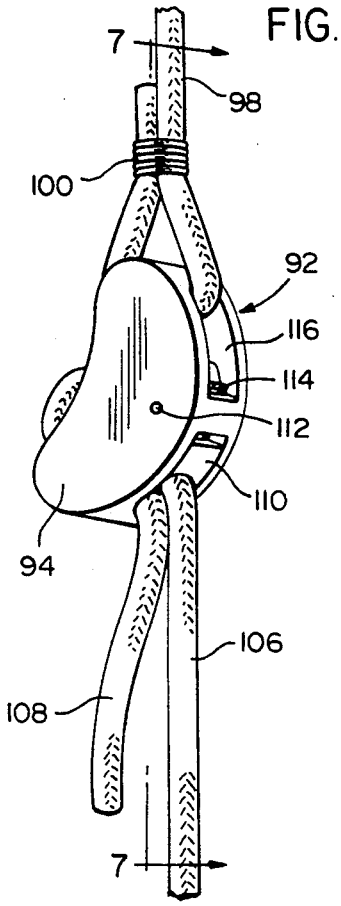
FIG. 6 is a perspective view of a further embodiment of the invention utilizing an optional frictional lock.
Figure 7:
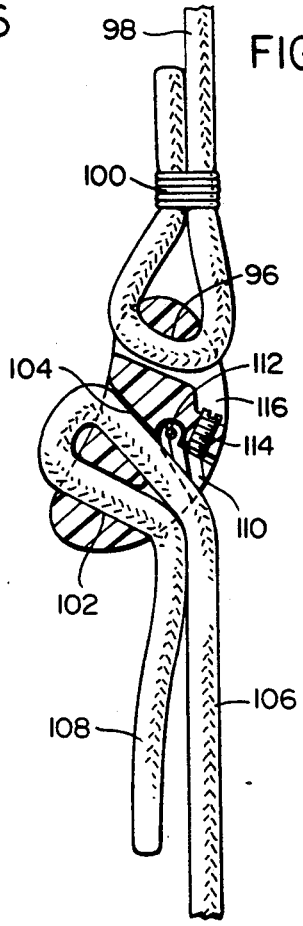
FIG. 7 is a vertical sectional view taken along section line 7—7 on FIG. 6 illustrating further structural details of this embodiment of the invention.

FIGS. 6 and 7 illustrate another embodiment of the adjustable rope lock 92 including a body 94 similar to that illustrated in FIG. 4 with the upper end thereof including a passageway 96 receiving an anchor rope or cord 98 therethrough which is secured thereto by a binding 100 or clamp or a knot can be tied in the anchor rope 98. This supports the body 94 in a manner similar to that illustrated in FIGS. 4 and 5. The body includes passageways 102 and 104 receiving a load or taut rope segment 106 and a pull rope segment 108 which function in the same manner as in FIGS. 1-5. In this embodiment of the invention, a mechanical lock device in the form of a pivotal lock member 110 is associated with the passageway 104 with the pivotal lock member being supported by a pivot pin 112 at the inner end thereof. The outer end portion of the pivotal lock member 110 is engaged by a set screw 114 which extends threadedly through a portion of the body 94 with the upper end thereof communicating with the recess 96 which is enlarged at 116 to enable a hand implement such as a screw driver, Allen wrench or the like to be engaged with the set screw 114 to move the locking member 110 into locking engagement with the taut rope segment 106 to securely and positively lock the rope segments in adjusted position in situations where it is desirable to permanently secure the rope segments in an adjusted position. When the lock member 110 is released, the rope segments 106 and 108 function in exactly the same manner as the load or taut rope segment and the pull or adjustable rope segment function in FIGS. 1-5.

Figure 8:
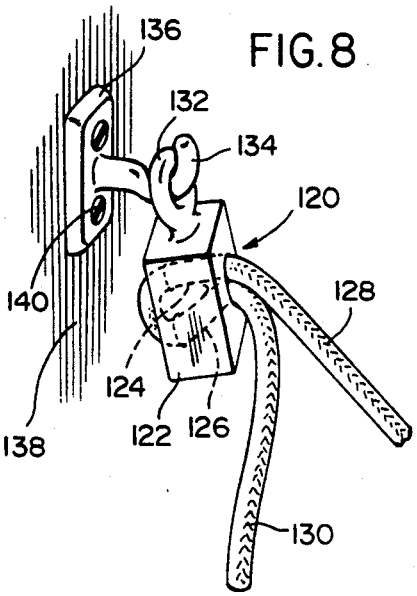

FIG. 8 illustrates a further embodiment of the adjustable rope lock generally designated by reference numeral 120 which includes a body 122 having passageways 124 and 126 therein which receive a load or taut rope segment 128 and a pull or adjustable rope segment 130 which function in the same manner as the embodiments illustrated in the preceding figures. In this construction, the body 122 includes an integral ring or eye 132 on one end thereof to pivotally support the rope lock 20 from a hook 134 having a mounting plate 136 on one end thereof for attachment to a wall surface or the like 138 by screw threaded fasteners 140 or other anchoring means.

Figure 9:
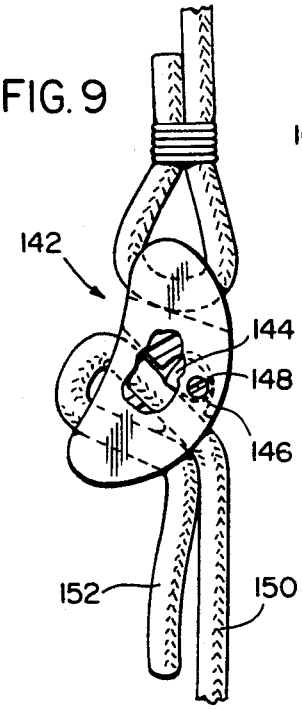
FIG. 9 is an elevational view, with portions broken away, illustrating a further embodiment of the invention.

FIG. 9 discloses another embodiment of the invention generally designated by reference numeral 142 which is very similar to that illustrated in FIGS. 6 and 7 except that the pivotal locking member designated by reference numeral 144 is anchored to a pivot pin 146 having a screwdriver receiving kerf 148 in the end thereof to enable a tool such as screwdriver to engage the kerf 148 to pivot the locking member 148 into locking engagement with the load rope segment 150 to securely lock the rope segments 150 and 152 in adjusted position when desired.

Figure 10:
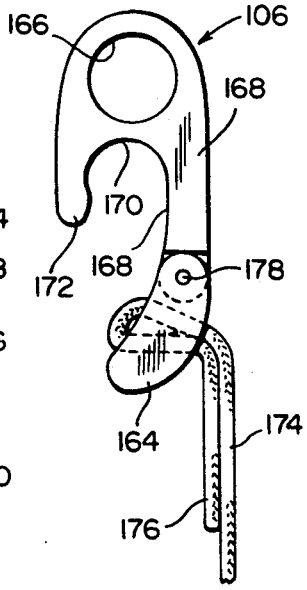

FIG. 10 illustrates another embodiment of the invention generally designated by reference numeral 160 which includes a supporting bracket structure 162 and a body 164 at the lower end thereof. The bracket structure 152 includes a circular opening at the upper end thereof as indicated by reference numeral 166 and a laterally opening recess 168 below the aperture 166. The recess 168 includes a circular upper portion at 170 and an entrance area 172 which enables the device to be snapped onto a supporting rail such as a rail found on many boats to enable the bracket 160 to be attached thereto with the body 164 supported therefrom with the load or taut rope segment 174 and adjustable or pull rope segment 176 functioning in the same manner as in the previous embodiments and related to the body 164 in the same manner. The body 164 is pivotally attached to the bracket 162 by pivot pin 178 which enables the body 164 to be manipulated in the same manner as the other embodiments of the invention. The opening 166 is of sufficient size to receive a finger therethrough to enable the device to be handheld by inserting one finger through the opening 166 and possibly another finger into the recess 168 to enable the bracket 162 to be used as a finger grip. Thus, the adjustable rope lock is incorporated into a bracket structure that can be pivotally connected to a rail on a boat with the entranceway 172 enabling the bracket to engage the rail with a snapping action. This structure also enables the bracket 162 to be used as a handheld device or connected to various other supporting structures by using the aperture 166.

Figure 11:
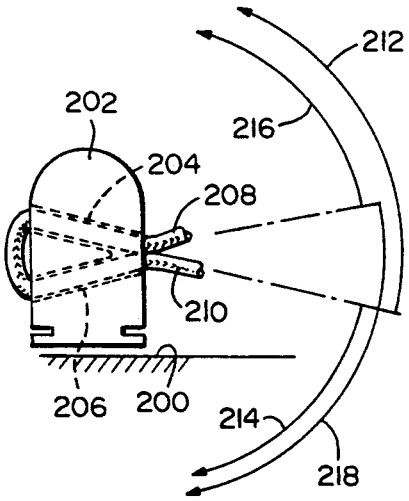
FIG. 11 is a schematic illustration of the positioning of the rope segments.

FIG. 11 illustrates schematically the orientation of the passageways and the load rope or taut rope segment and the adjustable or pull rope segment with the arcuate arrowed lines indicating the orientation capabilities of the rope segments.

In this structure, the ground line or horizontal plane is designated by reference numeral 200 with a body or bracket 202 extending upwardly therefrom and connected in any suitable manner to a supporting structure. The body 202 includes passageways 204 and 206 therethrough receiving load or taut rope segment 208 and pull rope segment 210 therethrough as set forth in more detail in conjunction with the various embodiments of the invention.

Arcuate reference line 212 indicates the free pulling area for the load or taut rope segment 208 which indicates that when the taut rope segment 208 is at any angle between the ends of the line 212 and the pull line segment 210 is free, the segment 208 can be freely pulled. The arcuate line 214 indicates the locking area for taut rope segment 208. Thus, anytime the segment 208 is oriented at an angle indicated by arcuate line 214, the segment 208 will be locked even though segment 210 does not have any load thereon. Arcuate line 216 indicates the locking area for the segment 210. Thus, if the segment 210 is oriented in the angular position illustrated by arcuate line 216, it will be locked since it will have upward bearing pressure against the taut rope segment 208 since the segment 210 is pulled upwardly against the segment 208 thus preventing movement of the rope segments 210 and 208. The arcuate line 218 indicates the free pulling area for segment 210. Thus, anytime the segment 210 is in an angular position indicated by the arcuate line 218, it can be pulled to take up any slack or increase tension on the taut rope segment 208.

As indicated by the various embodiments illustrated in the drawings, the adjustable rope lock of this invention can be used in many orientations and environments with the load line or load rope segment and the loose line or adjustable rope segment being either free to be moved or locked by positioning within the angles of disposition indicated by FIG. 11. Thus, by tilting or twisting the body with the passageways therein or moving the lines in angular relation to the body, the line or rope segments can be moved longitudinally by a single hand operation and securely locked in adjusted position. I those embodiments of the invention in which the body can be tilted or pivoted, it is only necessary to exert thumb or finger pressure to pivot the body to orient the passages toward a generally vertical position as compared to the inclined position illustrated, for example in FIG. 7 in order to release the taut line segment 208 to enable it to be moved in a linear direction outwardly from the body whereas merely pulling on the pull rope segment 210 will move the segment in a linear direction when the components are oriented in the manner illustrated in the various embodiments of the invention in the drawings.

Figure 3A:
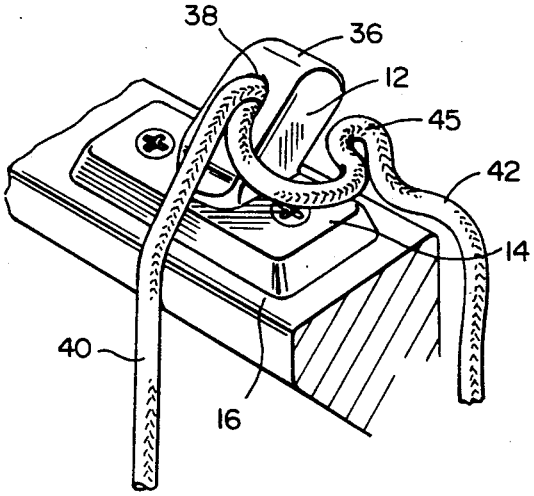
FIGS. 3A and 3B are views similar to FIG. 3 illustrating how the rope segments can be permanently locked.
Figure 3B:
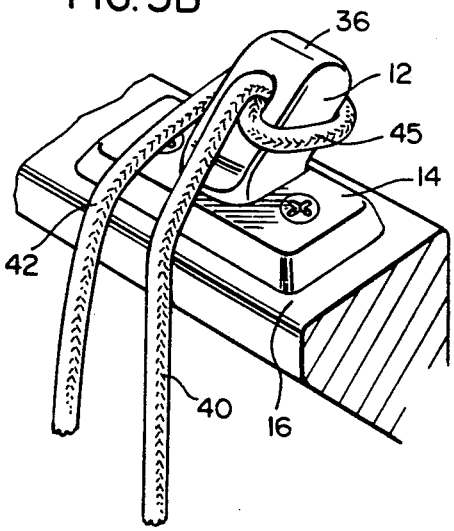

FIGS. 3A and 3B indicate a manner in which the rope segments 40 and 42 can be permanently locked in adjusted position. The pull rope segment 42 is wrapped around the body as indicated by reference numeral 45 so that it is located under the taut rope segment 40 and then extends outwardly from a position rearwardly of the body 12 and forwardly along an opposite side of the body 12 as compared to the position of the portion 45 of the rope segment 42 alongside the body 12. The pull rope segment 42 then is oriented generally in the same manner as FIG. 3 with the engagement of the pull rope segment around the body 12 securely locking the rope segments in adjusted position with the portion of the rope segment 42 extending rearwardly of the body being received interiorly of the portion of the rope segment which extends between the vertically spaced ends of the passageway 28 and 30.

Figure 4A:
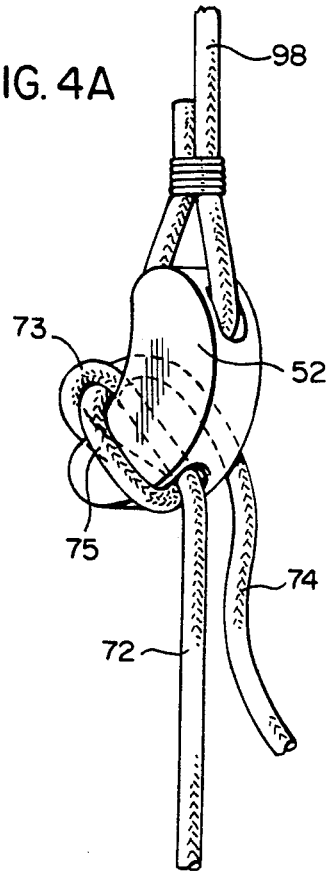
FIG. 4A is similar to FIG. 4 to show a lock feature.

FIG. 4A illustrates a similar locking arrangement for the rope lock utilizing the body 52 which can be supported by the hook and resilient cord or by the supporting rope 98 such as is shown in FIG. 6. In this construction, the pull rope segment 74 is wrapped rearwardly as indicated at reference numeral 75 and extends through the loop 73 between the spaced ends of the passageway 68 and 70 with the portion 75 of the pull rope segment 74 then extending forwardly along the opposite side of the body 52 and generally alongside of the taut rope segment 72.

Figure 1:
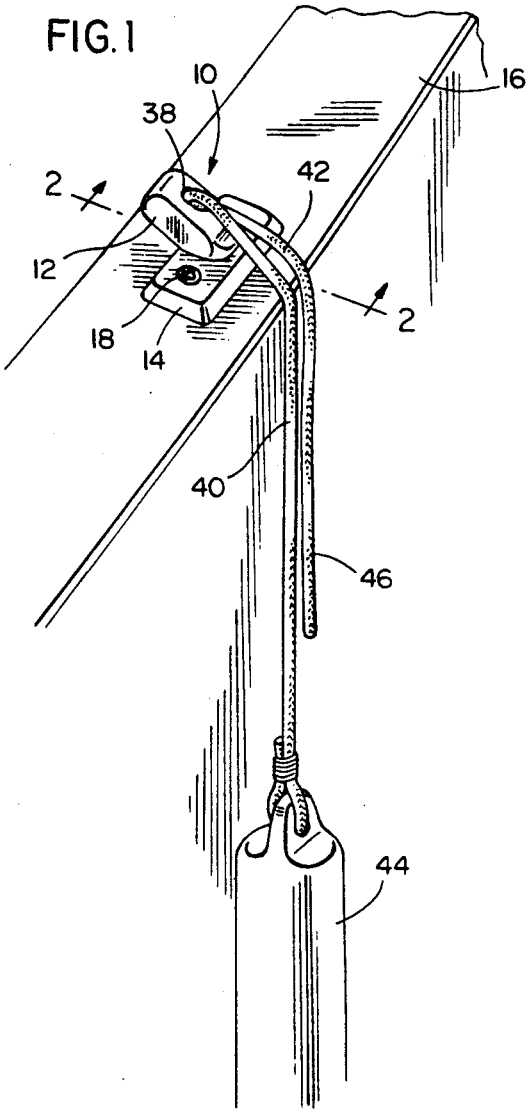
FIG. 1 is a perspective view of one embodiment of the adjustable rope holder of the present invention for adjustably supporting a fender supported from a boat to protect the boat from damage from contact with a dock.
Figure 11A:
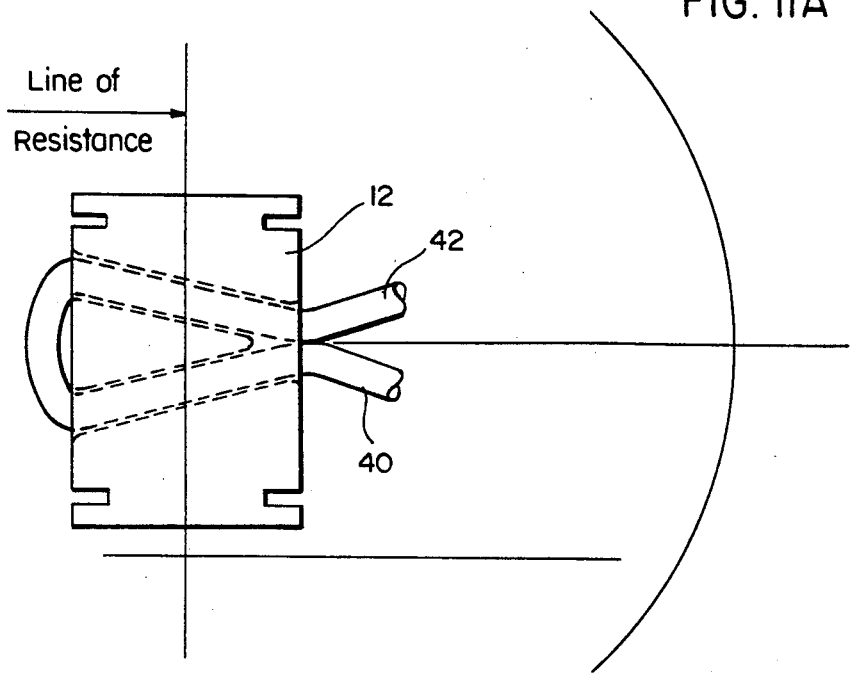
FIG. 11A is a schematic illustration of the relation of the rope segments to the line of resistance.
Figure 11B:
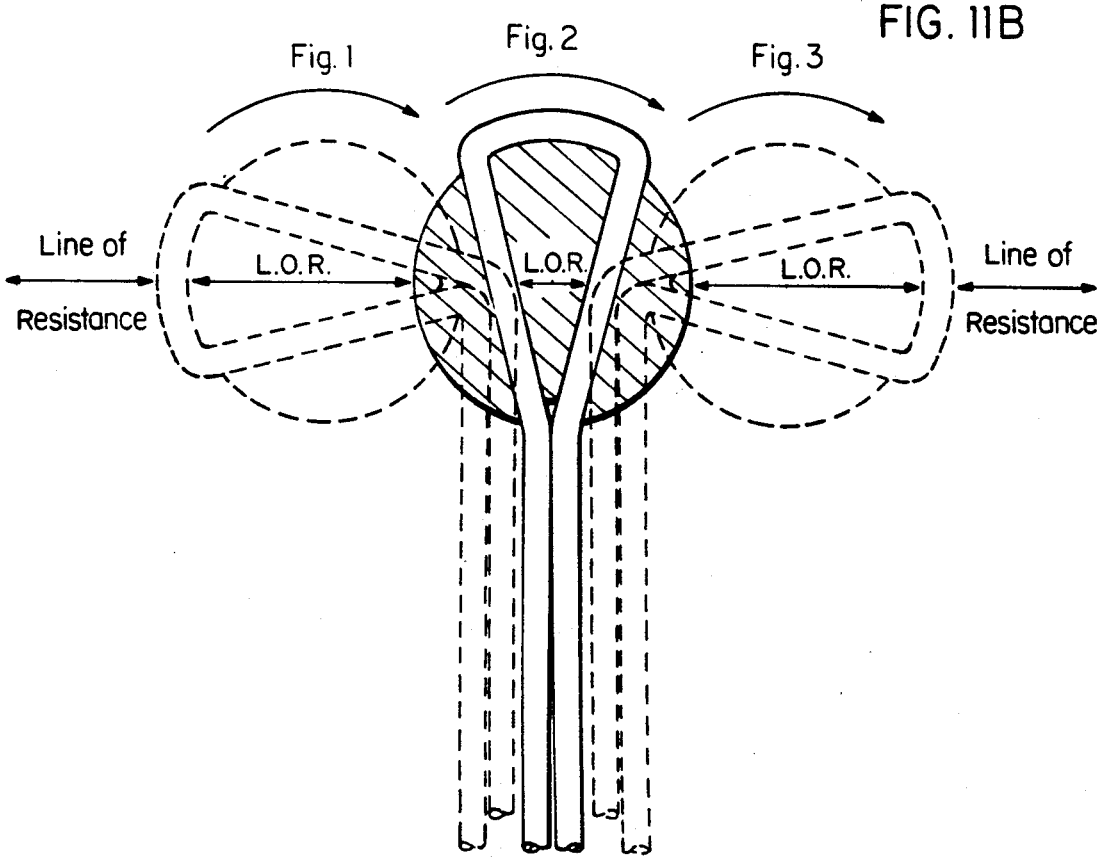
FIG. 11B is a schematic illustration of the invention oriented in different positions with respect to the line of resistance.

FIG. 11A and FIG. 11B disclose schematically the structure illustrated in FIG. 11 and positioning of the various bodies in relation to a line of resistance (LOR) exerted by the body on the rope segments illustrating schematically the orientation of the taut rope segment 40 and pull rope segment 42 in relation to the line of resistance with the body oriented in three different positions indicated by the arcuate lines designated FIGS. 1, 2 and 3 in FIG. 11B.

Figure 12:
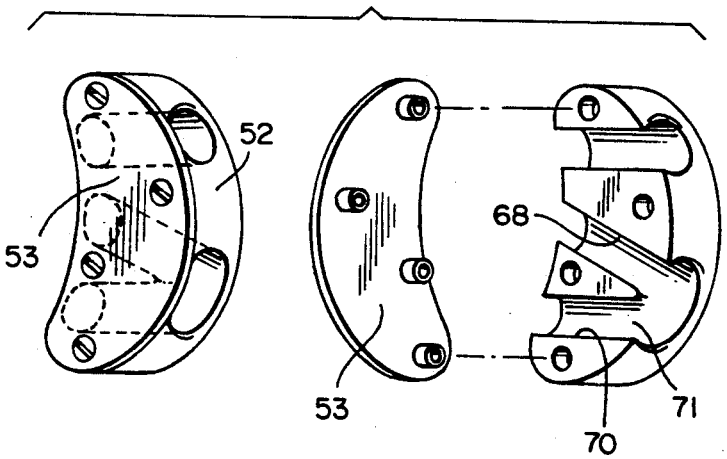
FIG. 12 is a group perspective view of the structure of the body in FIGS. 4–7.

FIG. 12 illustrates the structure of the body 52 as being constructed of separable components in the form of a removable plate 53 and the passageways 68 and 70 being defined by grooves 71. Suitable fastening structures are utilized to secure the removable plate 53 to the remainder of the body 52.

While the body may be constructed of various materials, the construction from a plastic material has been found acceptable for many uses with the size of the passageways and body being varied of course to receive different size ropes and flexible lines thereby providing a highly effective and relatively inexpensive adjustable rope lock.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An adjustable rope lock comprising a body having opposed surfaces, means supporting said body from a supporting structure, said body including a pair of passageways extending between and communicating with the opposite surfaces, said passageways having one of their ends in spaced relation in one of said opposed surfaces, the other ends of said passageways merging and joining into a single, generally elliptically shaped opening in the other of said surfaces, a flexible rope extending through said passageways with the free ends of the rope exiting from the generally elliptical opening with one of the rope segments being above the other as they exit from the generally elliptical opening with the upper rope segment being taut and the lower rope segment being loose to form a pull rope segment whereby the taut rope segment will bear against and frictionally lock the pull rope segment against linear movement into the generally elliptical opening when the taut rope segment is oriented in an angular position extending outwardly and downwardly from the body with the pull rope segment being movable outwardly in a linear direction when the pull rope segment is located below the taut rope segment.

2. The structure as defined in claim 1 wherein outward linear movement of the pull rope segment enables a single hand operation to maintain tension on or adjust the taut rope segment by taking up slack or exerting tension thereon by pulling outwardly on the pull rope segment.

3. The structure as defined in claim 2 wherein said means supporting said body from a supporting structure includes a bracket plate adapted to be mounted on a boat, said body being detachably connected to the bracket plate with the taut rope segment adjustably supporting a fender for protecting the boat from contact with a dock.

4. The structure as defined in claim 2 wherein said body is supported by a resilient cord having a hook on the end, said body including a recess receiving the hook by which the body is connected to said resilient cord, said body being tilted by exerting thumb or finger pressure thereon to move the passageways from a rope locking to a rope releasing position to enable adjustment thereof.

5. The structure as defined in claim 2 wherein said means supporting said body from a supporting structure includes a recess receiving a knotted end of a supporting rope.

6. The structure as defined in claim 2 wherein said means supporting said body from a supporting structure includes an eye formed on said body and a hook shaped member engaging said eye for supporting the body for pivotal movement from a supporting structure.

7. The structure as defined in claim 2 wherein said means supporting said body from a supporting structure includes a bracket, means pivotally supporting the body at one end of the bracket, and means on the other end of the bracket for snap engagement with a rail-type support with the bracket also including an aperture receiving a finger of a user to enable finger grip engagement with the bracket and adjustable rope lock.

8. The structure as defined in claim 1 wherein said passageways converge towards the generally elliptical opening and oriented in a manner with the taut rope segment being locked when in a position slightly below horizontal to a generally downwardly depending relation to the body and free to move when in a position extending slightly below horizontal to an upwardly extended position, said pull rope segment being free to move when in a position slightly above horizontal to a downwardly depending position and being locked when in a position slightly above horizontal to an upwardly extended position.

9. The structure as defined in claim 1 wherein said pull rope segment is wrapped around the body and inserted under the portion of the rope segments extending between the spaced openings in one surface of the body with the pull rope segment then extending alongside of the taut rope segment to permanently lock the rope segments in adjusted position.

10. An adjustable rope lock comprising a body having a pair of angularly disposed passageways therethrough, a rope extending through the passageways, one end of the passageways merging into a single elongate opening at one surface of the body and including spaced ends at another surface of the body and means supporting said body whereby the angle of a taut rope segment of the rope approaches the line of resistance provided by the body to the force exerted on the taut rope segment, to frictionally lock the rope segments when the taut rope segment approaches said line of resistance.

11. The structure as defined in claim 1 wherein said body supporting means supports the body in a rigid manner.

12. The structure as defined in claim 1 wherein said body supporting means enables the body to be tilted to vary the angular relation between the rope segments and the line of resistance provided by the body.

13. An adjustable rope lock comprising a body having opposed surfaces, means supporting said body from a supporting structure, said body including a pair of passageway extending between and communicating with the opposite surfaces, said passageways having one of their ends in spaced relation in one of said opposed surfaces, the other ends of said passageways merging and joining into a single oval shaped opening in the other of said surfaces, a flexible rope extending through said passageways with the free ends of the rope exiting from the elongate opening as rope segments, one of said rope segments being above the other as they exit from the elongate opening with an upper rope segment being taut and a lower rope segment being loose to form a pull rope segment whereby the taut rope segment will bear against and frictionally lock the pull rope segment against linear movement into the elongate opening when the taut rope segment is oriented in an angular position extending outwardly and downwardly from the body with the pull rope segment being movable outwardly in a linear direction when the pull rope segment is located below the taut rope segment, said passageways converging toward said elongate opening with at least a portion of the passageways being spaced apart by a wedge-shaped component of said body.

14. The adjustable rope lock as defined in claim 13 wherein said means supporting said body from a supporting structure is oriented above the upper rope segment and enables pivotal movement of the body in the plane of the rope segments when finger or thumb pressure is exerted on said body to pivot said body to position said passageways into a position that enables the taut rope segment to move outwardly in a linear direction in relation to said elongate opening.

* * * * *